US005582291A

United States Patent [19]

Schroeder et al.

[11] Patent Number: 5,582,291

[45] Date of Patent: Dec. 10, 1996

[54] SUSPENDABLE CARRYING DEVICE FOR DECORATIVE LIGHTS

[76] Inventors: Lyman L. Schroeder, 609 Maple, Dimmitt, Tex. 79027; Charles L. Miller, P.O. Box 1181; Douglas W. Setliff, P.O. Box 290, both of Dimmitt, Tex. 79027

[21] Appl. No.: 413,077

[22] Filed: Mar. 29, 1995

[51] Int. Cl.[6] ..... B65D 85/42

[52] U.S. Cl. ..... 206/419; 206/486; 206/806

[58] Field of Search ..... 206/418–422, 206/443, 526, 806, 820, 486, 459.5; 211/26; 248/450

[56] References Cited

U.S. PATENT DOCUMENTS

| | | | |
|---|---|---|---|
| 1,884,445 | 10/1932 | Wever | 206/486 X |
| 2,741,411 | 4/1956 | Older | 206/422 X |
| 2,778,336 | 1/1957 | Liguori | 206/820 X |
| 3,064,457 | 11/1962 | Vanden Boom et al. | 206/419 |
| 3,225,922 | 12/1965 | Straight | 206/419 |
| 3,384,227 | 5/1968 | Spatz . | |
| 3,431,548 | 3/1969 | Busler | 206/820 X |
| 3,770,120 | 11/1973 | Henson | 206/486 X |
| 4,171,743 | 10/1979 | Mascia et al. | 206/806 X |
| 4,531,638 | 7/1985 | Jacobozzi et al. . | |
| 4,651,873 | 3/1987 | Stolcenberg et al. | 206/486 X |
| 4,798,286 | 1/1989 | Musearelli | 206/150 |
| 4,917,323 | 4/1990 | Wing . | |
| 5,033,619 | 7/1991 | Garis . | |
| 5,064,067 | 11/1991 | McAllister et al. . | |
| 5,123,534 | 6/1992 | Chwang . | |
| 5,152,396 | 10/1992 | Chen et al. . | |
| 5,317,491 | 5/1994 | Lee . | |
| 5,381,899 | 1/1995 | Rabbitt . | |

FOREIGN PATENT DOCUMENTS

| | | |
|---|---|---|
| 2083292 | 12/1993 | Canada . |

*Primary Examiner*—Bryon P. Gehman
*Attorney, Agent, or Firm*—Novak Druce Reynolds Burt

[57] ABSTRACT

The present invention is a suspendable carrying device for decorative light strings wherein the light strings include a plurality of light bulbs connected to the others and each bulb has an enlarged portion of greater diameter than the neck portion. The carrying device comprises a body member having an elongated track extending through the body member where at least one expanded aperture is located along a length of the elongated track. The expanded aperture has a greater width than the elongated track which is sufficient to accommodate insertion of the enlarged portion of each light bulb therethrough. The elongated track has a width sufficient to accommodate the neck portion of each light bulb therein and prevent passage of the enlarged portion of each light bulb therethrough.

11 Claims, 1 Drawing Sheet

SUSPENDABLE CARRYING DEVICE FOR DECORATIVE LIGHTS

BACKGROUND OF THE INVENTION

1) Field of the Invention

The present invention relates generally to carrying devices for decorative lights, and more particularly to a suspendable carrying device for decorative lights on a wire string.

2) Description of the Related Art

Decorative light carrying devices are well known in the art. Several patents have issued concerning carrying devices for decorative lights. U.S. Pat. No. 3,384,227 to Spatz for Christmas Tree Lights Storage Container and U.S. Pat. No. 5,033,619 to Garis for Light String Carrier include the disclosure of containers designed to hold wire strings of decorative lights. U.S. Pat. No. 5,064,067 to McAllister et al. for Christmas Light Organizer and Canadian Patent 2,083,292 to Blot for Holder for a String of Lights include the disclosure of suspendable decorative light carrying devices. Applicants have a co-pending application entitled Suspendable Carrying Device for Decorative Lights, filed Mar. 31, 1995, Ser. No. 29/037383.

Examining these devices however reveals several problems. Problems with some of these devices include the entanglement of the electrical wiring and the lights during storage. An additional problem is the possibility of damaging the lights while hanging the device because the lights will be placed on both sides of the device, instead of segregating the wire from the lights. Because the lights are on both sides of the device, both sides need to be shielded to prevent bulb breakage from outside forces. Another problem with other devices is their complexity causes increased manufacturing costs.

SUMMARY OF THE INVENTION

The current invention is a suspendable carrying device for decorative lights that segregates the wire from the light bulbs when decorative lights are stored, thereby allowing the side with the protruding wire to be exposed to outside forces while the other side with the protruding light bulbs can be placed in an area where the bulbs will be protected. Also segregating the wire from the bulbs prevents the wire and the bulbs from becoming entangled. Furthermore, the device has a thin body member with an opening in the middle of the body member for storage of decorative lights. Due to the simple construction of the device, these devices can be manufactured at a low cost. Also these devices have a small hole near their base whereby several devices can be connected together in series.

It is an object of the present invention to provide a suspendable carrying device for decorative lights that can be manufactured inexpensively.

It is a further object of the present invention to provide a suspendable carrying device for decorative lights that segregates the wire from the bulbs thereby preventing the wire and the bulbs from becoming entangled.

An additional object of the present invention is to provide a suspendable carrying device having a plurality of substantially horizontal brace supports and a plurality of expanded apertures whereby the frame of the device is strengthen and several strings of lights can be stored in the device.

In accordance with these aims, one embodiment of the present invention is a suspendable carrying device for a decorative light string wherein the light string includes a plurality of light bulbs connected to the others and each bulb has an enlarged portion of greater diameter than the neck portion. The carrying device comprises a body member having an elongated track extending through the body member where at least one expanded aperture is located along a length of the elongated track. The expanded aperture has a greater width than the elongated track which is sufficient to accommodate insertion of the enlarged portion of each light bulb therethrough. The elongated track has a width sufficient to accommodate the neck portion of each light bulb therein and prevent passage of the enlarged portion of each light bulb therethrough.

Another embodiment of the present invention is a suspendable carrying device for decorative lights comprising a body member including an elongated track. The upper portion of the elongated track includes an expanded aperture that has a greater width than the elongated track whereby the neck of the decorative light is inserted and moved downward therein.

An additional embodiment of the present invention is a suspendable carrying device for decorative lights comprising a body member and a suspension mechanism coupled to the body member. The body member further includes an elongated track wherein the upper portion of the elongated track includes an expanded aperture having a greater width than the track.

BRIEF DESCRIPTION OF THE DRAWINGS

The present invention is further described in connection with the accompanying drawings, in which.

DETAILED DESCRIPTION OF THE INVENTION

Figure 1:
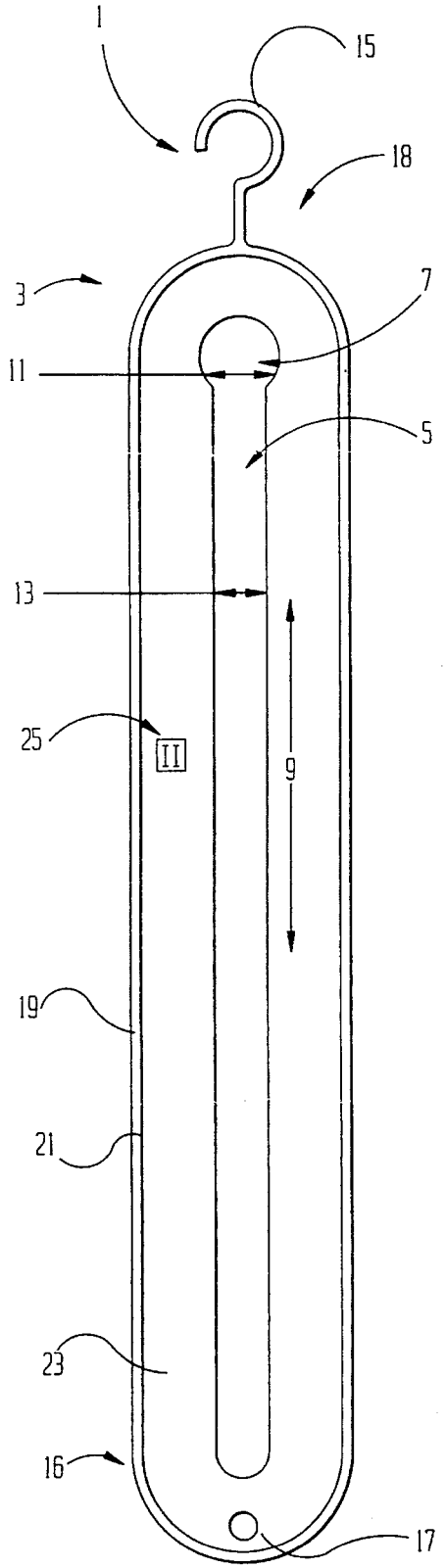
FIG. 1 is a front view of one embodiment of the present invention.
Figure 3:
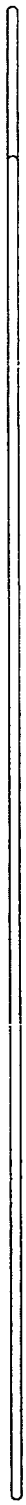
FIG. 3 is a side view of the present invention.

One embodiment of the present invention is illustrated in FIG. 1 and FIG. 3. Referring now to FIG. 1, a suspendable carry device 1 for decorative lights is preferably constructed from plastic. However it should be pointed out that the device could be manufactured from other materials such as metal or a combination of metal and plastic. Therefore for the purpose of this description the term "member", as used hereinafter, shall be understood to be possibly manufactured from any material suitable for lightweight and inexpensive construction. Furthermore, in the claims the elements have been recited as being "coupled"; the reason being that it is anticipated that elements may be connected together in such a way that there are other components interstitially located between the connected elements or that the elements may be connect in fixed or movable relative one to the other.

Referring to FIG. 1, the suspendable carrying device 1 includes a body member 3. An elongated track 5 is positioned in the middle of the member 3 for storage of the decorative lights. At least one expanded aperture 7 is located along the length 9 of track 5. Aperture 7 is preferably located in the upper portion of track 5. The width 11 of aperture 7 is greater than the width 13 of track 5. The greater width of aperture 7 allows the bulb of a light to be inserted into and through aperture 7. Sliding the light bulb downward into track 5 will hold the light in place because the bulb will protrude on one side of member 3 while the neck and wire of the bulb will protrude on the other side of member 3. Once one bulb is placed in aperture 7 and lowered downward, the rest of the bulbs can be inserted in aperture 7 and successively slid downward. The bulbs are stacked one on top of the other. Bulbs can be inserted into aperture 7 until track 5 is filled.

A suspension receiver mechanism 17 is located at the lower end 16 of member 3. Receiver mechanism 17 is an aperture, though receiver mechanism 17 could also take the form of VELCRO fasteners or a groove.

A suspension mechanism 15 is coupled at an opposite end 18 of member 3 from receiver mechanism 17. Suspension mechanism 15 is a hook, though suspension mechanism 15 could also take the form of any number hanging devices, such as a spike, clip, or VELCRO. A plurality of devices 1 can by connected together by inserting the hook of one device 1 into the aperture of another device 1 whereby a series of devices can be suspended end-to-end.

The device 1 further comprises a frame 19 that surrounds the perimeter 21 of member 3. A support member 23 is located inside of the frame 19 which contains elongated track 5 and expanded aperture 7. The support member 23 should be made of a flexible material and be strong enough to house the decorative lights. The frame 19 should also be constructed of a strong, rigid material to hold support member 23 and maintain the shape of the carrying device 1. As shown by FIG. 3, support member 23 is constructed from a thin sheet of material. Therefore frame 19 is constructed from a material strong enough to provide support to member 23. The combination of support member 23 and frame 19 gives device 1 its thin, unibody shape. This shape allows device 1 to be manufactured and moved with ease.

An identifying mechanism or identifier 25 can be releasably coupled to member 3. By use of an identifier 25, the location of where particular strings of lights are to be installed can be indicated on device 1. Furthermore identifier 25 can be used with several devices 1 holding separate strings to indicate in what order those strings should be placed on or in the building. The identifier 25 can be colors or a note taped next to the stored string of lights. The identifying mechanism 25 as shown in FIG. 1 is a set of numbers 25, as shown by the "II". The set of numbers 25 are coupled to the device by a glue on the back of the numbers and correspond to locations in or on the building where the lights are to be placed during the holiday season.

Figure 2:
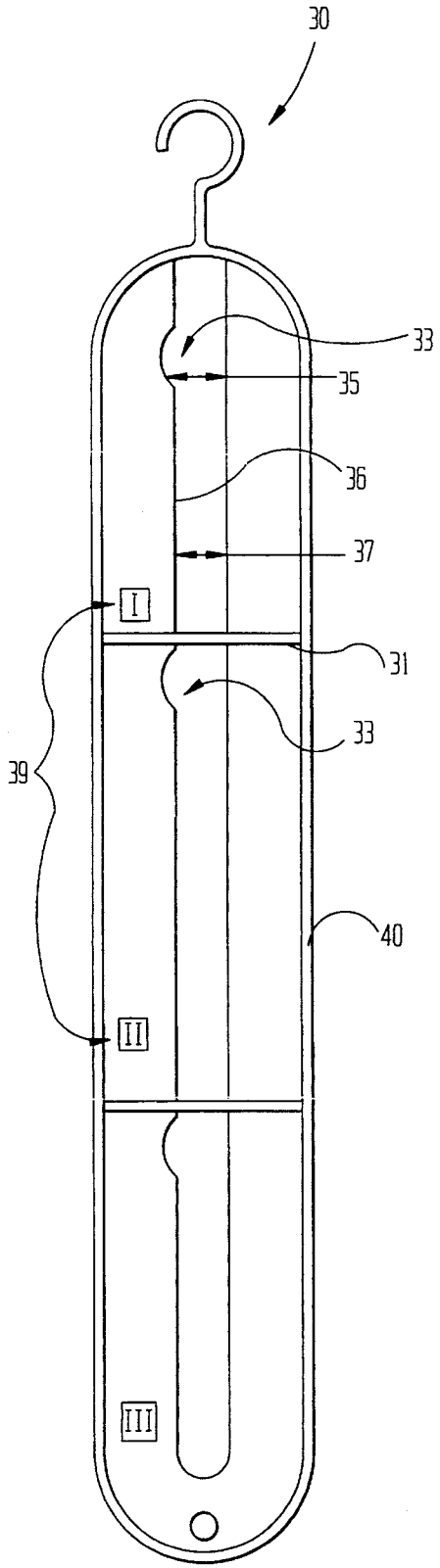
FIG. 2 is a front view of the preferred embodiment of the present invention.

Referring to FIG. 2, the preferred embodiment of the invention is shown. The suspendable carrying device 30 differs from device 1 in that at least one substantially horizontal brace member 31 is added to the device 30, though two members 31 are present.

Another difference is device 30 contains a plurality of expanded apertures 33. The width 35 of the aperture 33 exceeds the width 37 of track 36. A further difference is track 36 extends to frame 40.

The brace members 31 and expanded apertures 33 of the preferred embodiment allow for the storage and segregation of several strings of lights on a single device 30. An identification mechanism or identifier 39 can be used to indicate where light strings are to be hung in or on the building. The mechanism 39 used is a set of numbers 39. The numbers, "I, II, and III", can be glued next to each string corresponding to where strings are to hung in or on the building or the order in which the strings are to be strung.

While the preferred embodiment of the invention has been shown and described, it will be apparent to those skilled in this art that various modifications may be made in the embodiment without departing from the spirit of the present invention.

Therefore, the embodiments of the invention in which an exclusive property or privilege is claimed are defined as follows:

1. A suspendable carrying device for a decorative light string wherein the light string includes a plurality of light bulbs connected one to the others and each bulb having an enlarged portion of greater diameter than a neck portion thereof; said carrying device comprising:

a body member having an elongated track extending therethrough;

an expanded aperture located along a length of said elongated track;

said expanded aperture having a greater width than said elongated track and of sufficient size to accommodate insertion of the enlarged portion of each light bulb therethrough;

said elongated track having a width of sufficient size to accommodate the neck portion of each light bulb therein and prevent passage of the enlarged portion of each light bulb therethrough; and said body member comprising a frame located substantially about a perimeter of said body member, and a support member located substantially within said frame and in which said elongated track and said expanded aperture are located.

2. The suspendable carrying device as recited in claim 1, further comprising:

a suspension mechanism coupled to said body member.

3. The suspendable carrying device as recited in claim 2, wherein said suspension mechanism is a hook.

4. The suspendable carrying device as recited in claim 1, further comprising:

a suspension mechanism receiver integral with said body member.

5. The suspendable carrying device as recited in claim 4, wherein said suspension mechanism receiver is an aperture extending through said body member.

6. The suspendable carrying device as recited in claim 5, further comprising:

said suspension mechanism receiver being located proximate to a lower end of said body member;

a suspension mechanism coupled to said body member proximate to an opposite end of said body member from said suspension mechanism receiver; and said suspension mechanism receiver being approximately sized to accommodate said suspension mechanism therein thereby providing a means by which a plurality of suspendable carry devices may be suspended in substantially end-to-end series.

7. The suspendable carrying device as recited in claim 1, further comprising:

said frame being rigid and providing support to said body member; and said support member being flexible and supported by said frame.

8. The suspendable carrying device as recited in claim 1, further comprising:

an identifier releasably couplable to said body member thereby allowing a user of said carrying device to easily identify a specific carrying device and any contents carried thereon.

9. The suspendable carrying device as recited in claim 8, further comprising:

said identifier comprises a set of numbers that may be selectively coupled to said body member for identifying the order of a plurality of carrying devices and any contents carried thereon.

10. The suspendable carrying device as recited in claim 1, said body member further comprising:

at least one substantially horizontal brace member; and a plurality of said expanded apertures.

11. A suspendable carrying device for a decorative light string wherein the light string includes a plurality of light bulbs connected one to the others and each bulb having an enlarged portion of greater diameter than a neck portion thereof; said carrying device comprising:

a body member having an elongated track extending therethrough;

an expanded aperture located along a length of said elongated track;

said expanded aperture having a greater width than said elongated track and of sufficient size to accommodate insertion of the enlarged portion of each light bulb therethrough;

said elongated track having a width of sufficient size to accommodate the neck portion of each light bulb therein and prevent passage of the enlarged portion of each light bulb therethrough;

said body member comprising a frame member positioned substantially about a perimeter of said elongate track and said aperture and a brace member connected between opposite sides of said frame member for restricting expansion of said sides away from one another.

* * * * *